US006722471B2

(12) United States Patent
Wolfe

(10) Patent No.: US 6,722,471 B2
(45) Date of Patent: Apr. 20, 2004

(54) SCAFFOLDING SYSTEM HAVING IMPROVED SAFETY STRUCTURES AND CONNECTING MEMBERS

(76) Inventor: Albert A. Wolfe, 2313 Harvard Dr., Flower Mound, TX (US) 75022

( * ) Notice: Subject to any disclaimer, the term of this patent is extended or adjusted under 35 U.S.C. 154(b) by 0 days.

(21) Appl. No.: 09/745,694

(22) Filed: Dec. 22, 2000

(65) Prior Publication Data

US 2002/0079165 A1 Jun. 27, 2002

(51) Int. Cl.[7] ..... E04G 1/00

(52) U.S. Cl. ..... 182/186.7; 182/178.5; 182/179.1; 182/186.8; 403/49

(58) Field of Search ..... 182/171, 172, 182/152, 186.7, 186.8, 178.5, 178.6, 179.1, 128; 403/49, 246

(56) References Cited

U.S. PATENT DOCUMENTS

| | | | | | |
|---|---|---|---|---|---|
| D111,651 | S | * | 10/1938 | Frost | 182/179.1 |
| 2,635,717 | A | * | 4/1953 | Albrecht | 182/178.5 X |
| 2,897,013 | A | * | 7/1959 | Delp | 182/178.5 |
| 3,221,837 | A | * | 12/1965 | Fisher | 182/152 |
| 3,409,266 | A | * | 11/1968 | Jennings | 182/186.8 X |
| 3,870,124 | A | * | 3/1975 | Howard | 182/178 |
| 3,885,648 | A | * | 5/1975 | Beziat | 182/178 |
| 3,902,817 | A | * | 9/1975 | Meir | 182/178.5 X |
| 3,955,644 | A | | 5/1976 | Steele | 182/82 |
| 3,978,634 | A | | 9/1976 | Mack et al. | 52/646 |
| 4,086,979 | A | | 5/1978 | Dunn | 182/93 |
| 4,122,631 | A | * | 10/1978 | Batcheller | 49/394 |
| 4,273,463 | A | * | 6/1981 | Dobersch | 403/246 |
| 4,452,337 | A | * | 6/1984 | Atzinger | 182/178 |
| 4,549,634 | A | | 10/1985 | Duncan et al. | 182/179 |
| 4,586,842 | A | | 5/1986 | Puccinelli | 403/246 |
| 4,782,914 | A | | 11/1988 | Nail | 182/113 |
| 4,807,719 | A | * | 2/1989 | Burkstrand et al. | 182/15 |
| 4,883,147 | A | * | 11/1989 | Davison et al. | 182/186.8 |
| 4,903,795 | A | * | 2/1990 | Cummings | 182/92 |
| 4,967,875 | A | | 11/1990 | Beeche | 182/36 |
| 5,086,875 | A | * | 2/1992 | Shreve, III | 182/152 |
| 5,099,953 | A | * | 3/1992 | Stegath | 182/152 |
| 5,127,758 | A | | 7/1992 | Kreusel | 403/171 |
| 5,133,152 | A | * | 7/1992 | Grancagnolo | 49/239 |
| 5,298,681 | A | * | 3/1994 | Swift et al. | 174/48 |
| 5,367,829 | A | * | 11/1994 | Crossley et al. | 49/465 |
| 5,555,954 | A | * | 9/1996 | Swiderski | 182/152 |
| 5,562,668 | A | * | 10/1996 | Johnson | 606/72 |
| 5,647,452 | A | * | 7/1997 | Gauthier | 182/117 |
| 5,715,908 | A | * | 2/1998 | Sager | 182/172 |
| 5,769,181 | A | * | 6/1998 | Gussow et al. | 182/118 |
| 5,797,695 | A | * | 8/1998 | Prusmack | 403/170 |
| 5,868,222 | A | * | 2/1999 | Charbonneau | 182/172 |
| 5,868,223 | A | | 2/1999 | Lubinski | 182/179.1 |
| 5,894,909 | A | * | 4/1999 | Cornish | 182/186.8 |
| 5,918,700 | A | * | 7/1999 | Gregory | 182/186.8 |
| 5,988,317 | A | * | 11/1999 | Riding | 182/152 |
| 5,992,564 | A | | 11/1999 | Kirkpatrick et al. | 182/117 |
| 6,027,276 | A | | 2/2000 | Schworer | 403/49 |
| 6,044,930 | A | | 4/2000 | Hayman | 182/206 |
| 6,237,298 | B1 | * | 5/2001 | Castano | 52/665.1 |
| 6,408,587 | B2 | * | 6/2002 | Cronin et al. | 52/637 |
| 6,443,262 | B1 | * | 9/2002 | Karanouh | 182/178.1 |
| 6,450,291 | B1 | * | 9/2002 | Ono | 182/178.1 |

* cited by examiner

*Primary Examiner*—Bruce A. Lev
(74) *Attorney, Agent, or Firm*—Gardere Wynne Sewell LLP; Kenneth T. Emanuelson

(57) ABSTRACT

An apparatus and method for construction of scaffold structures having improved safety characteristics. In various embodiments, the apparatuses comprise a set of structures, including connecting rails, fencing, gates, and ladders. The structures are adapted to be used with locking-cup type scaffold designs. In one embodiment, the apparatus comprises a scaffold joint comprising a vertical post comprising first and second joint sections. At least one structural brace is disposed within the joint sections having a mounting flange disposed at an angle to the principal axis of the structural brace.

16 Claims, 8 Drawing Sheets

12
46
48
39
42
40
52
50

12
48
46
42
44
39
40
52
50

39
36
18
12
16
16a
30
35
38
34
14

SCAFFOLDING SYSTEM HAVING IMPROVED SAFETY STRUCTURES AND CONNECTING MEMBERS

TECHNICAL FIELD OF THE INVENTION

The present invention relates generally to the field of construction scaffolding, and in particular to a system of scaffolding incorporating a set of features designed to improve both the functionality of the scaffolding and the safety characteristics thereof.

BACKGROUND OF THE INVENTION

In various applications, scaffolding is erected in order to give workers access to elevations above ground. For example, in the course of repairs to the outside surface of a building, modifications of the same, window washing, painting, cleaning, or installation of siding on the exterior of a building, scaffolding is commonly used to enable workers to move up and down adjacent the side of the building. Such devices are well known and take a wide variety of forms. One of the more conventional forms of scaffolding ordinarily includes one or more vertical posts that are interconnected by cross-braces and which may be stacked on top of each other to permit workmen to work at high elevations.

The scaffold platform typically includes a pair of metal side rails held in parallel spaced relation by a series of spaced transverse hollow rungs upon which metal or wooden planks are placed and secured to provide the floor of a work platform. These rungs may be round, or may have a square cross-section to provide flat upper surfaces upon which the wooden planks may rest and be supported. In order to provide workers access to multiple levels of the scaffolding, most scaffold installations incorporate ladders either integrally as part of the scaffold structure, or mounted to the scaffold structure by some form of attachment means.

Traditional scaffolding has been designed to provide workers with ready access to the surface of a flat wall, or to a right-angle corner of a building. Such scaffolding is useful for more traditional rectangular buildings, but such scaffolding has less utility in conjunction with structures having unconventional shapes. For example, round storage tanks present a unique and potentially dangerous problem for conventional scaffolding systems. Linear sections of conventional scaffolding must be brought together using independent clamps to conform to the surface of the tank. Conventional scaffolding is not designed for curved structures, hence, the clamped joints may become loose and create hazardous conditions for workmen.

Other hazards associated with scaffolds are well known. These hazards include loss of balance, slippage, and displacement of the scaffold due to movement of workers on the scaffold, wind, or other environmental factors. In order to protect the workers against falls, safety structures including guardrails and guard walls are often erected from the scaffold platform on one or both sides of the work platform. It is important that such safety structures be easy to assemble and attach to the platform and yet be firmly held in place with a minimum risk of failure.

One of the more popular scaffold construction designs includes a set of vertical columns having dual hemispherical couplers at regular intervals along their lengths. The vertical columns are tied together with horizontal members spanning between the vertical columns. Each end of each horizontal member is designed to mate with one quadrant of a dual hemispherical coupler. With this design, a single coupler can receive up to four horizontal members.

Although this scaffold design has proven to be useful, it has been found to be useful mostly for building scaffolds disposed against a single wall or against a right-angled structure. There has not been a satisfactory solution to the problem of scaffolding with this type of design against structures having diagonal or curved surfaces. Furthermore, although safety restraints and ladders have been developed that can be used in conjunction with this type of scaffolding, existing designs have been found to be heavy, difficult to assemble, or insufficiently compliant with government safety regulations.

SUMMARY OF THE INVENTION

The following summary of the invention is provided to facilitate an understanding of some of the innovative features unique to the present invention, and is not intended to be a full description. A full appreciation of the various aspects of the invention can be gained by taking the entire specification, claims, drawings, and abstract as a whole.

The present invention relates generally to the field of construction scaffolding, and in particular to a system of scaffolding incorporating a set of features designed to improve both the functionality of the scaffolding and the safety characteristics thereof. In its various embodiments, the present invention includes a number of novel structures and assemblies to facilitate safe and efficient assembly of scaffolding as well as improve the safety of workers using such scaffolding. In certain embodiments, the present invention facilitates the safe and efficient construction of scaffolding at the corner of structures where two walls meet at an angle greater or less than 90 degrees.

In one embodiment, the present invention includes a structural brace having a center section with a lengthwise axis, a first end, and a second end. A first mounting flange is attached rigidly to the first end, which includes a mounting surface having a center, an upper tab, and a lower tab. A second mounting flange is attached rigidly to the second end, and includes a mounting surface having a center, an upper tab, and a lower tab. The vector normal to the mounting surface at the center is disposed at an angle of between about 5 degrees and about 89 degrees to the lengthwise axis of the center section.

In another embodiment, the present invention also includes a guard rail panel including an upper brace section having a first end and a second end; a lower brace section having a first end and a second end, connected to the upper brace section by a bridging member. A first upper mounting flange, attached to the first end of the upper brace section, includes an upper tab and a lower tab. A second upper mounting flange, attached to the second end of the upper brace section, includes an upper tab and a lower tab. Finally, a first lower mounting flange, attached to the first end of the lower brace section, includes an upper tab and a lower tab and a second lower mounting flange is attached to the second end of the lower brace section, having an upper tab and a lower tab.

In yet another embodiment, the present invention is directed to a ladder assembly comprising a first vertical member, a second vertical member, one or more horizontal rungs connecting the first vertical member to the second vertical member, and one or more ladder mounting brackets. Each ladder mounting bracket has a first and second end, and is connected to a vertical member at the first end by a mounting clamp. The second end of each ladder mounting bracket has a mounting flange having an upper tab and a lower tab.

The novel features of the present invention will become apparent to those of skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the spirit and scope of the invention will become apparent to those of skill in the art from the detailed description of the invention and claims that follow.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Figure 1:
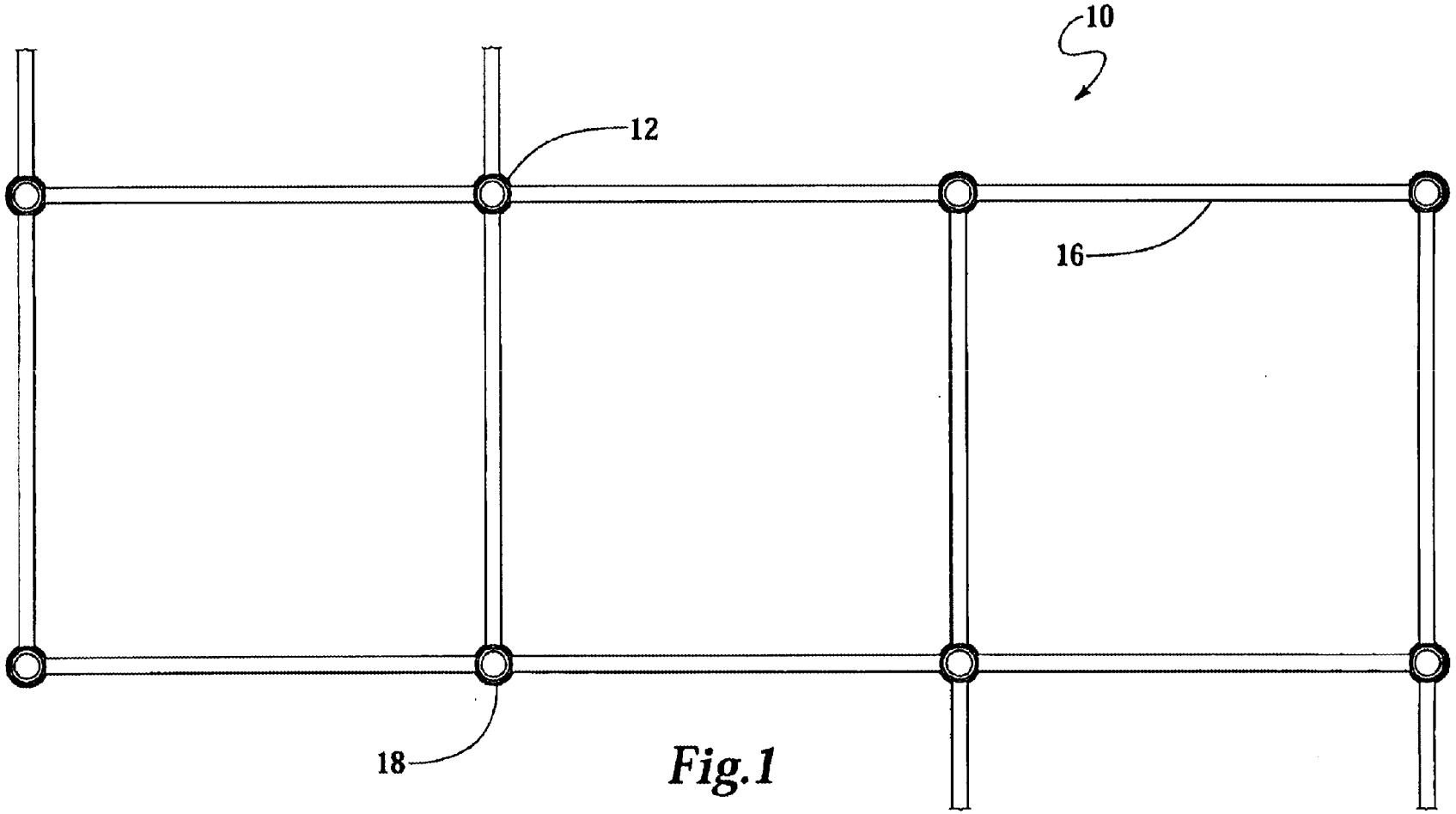
FIG. 1 is a plan view of a scaffolding system incorporating certain embodiments of the present invention.
Figure 2:
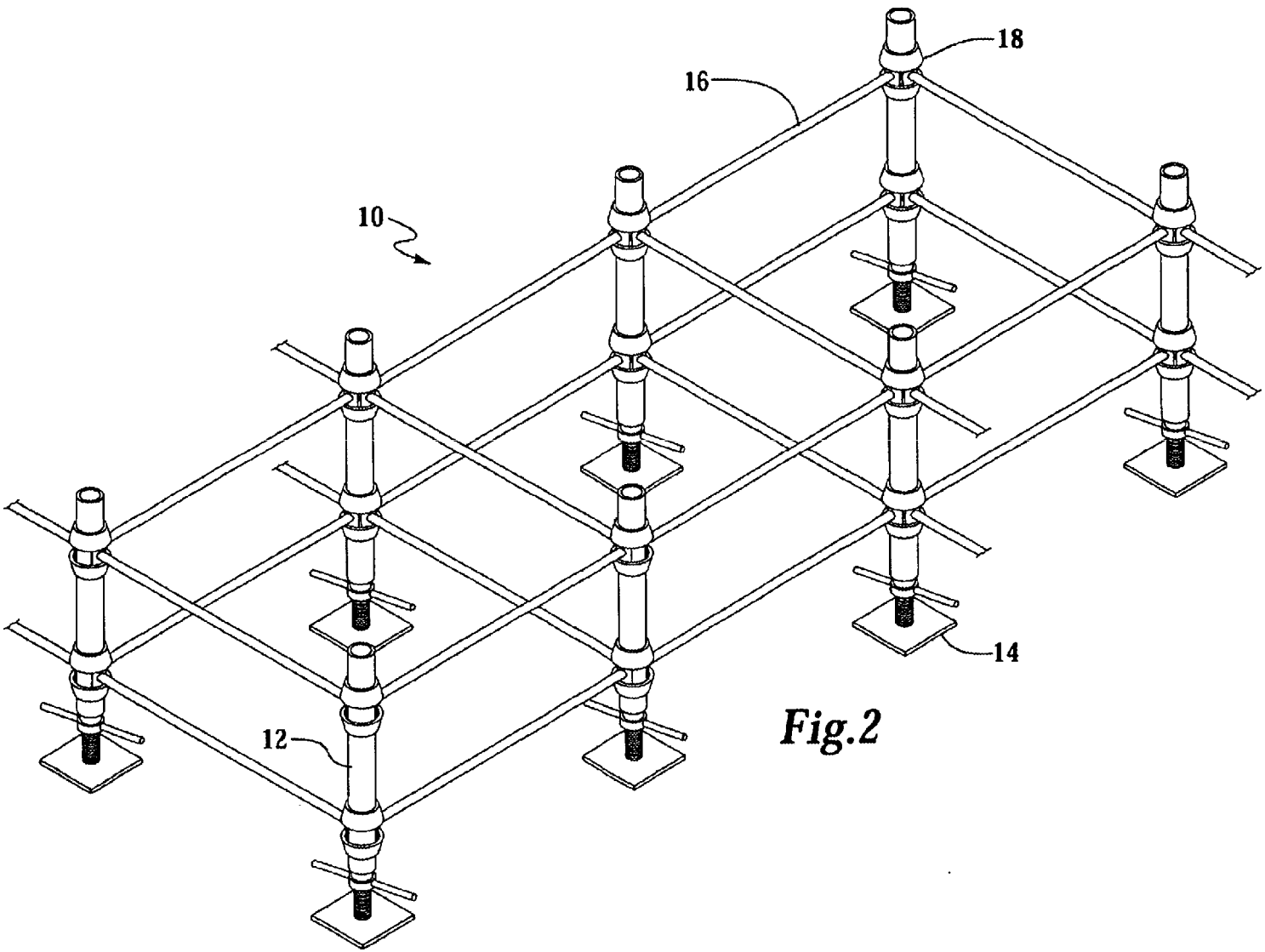
FIG. 2 is a perspective view of a scaffolding system incorporating certain embodiments of the present invention.

Referring to FIGS. 1 and 2, one configuration of a scaffolding system 10 is depicted. Posts 12 provide vertical support and may be supplied with a base 14. The base 14 may be a stable platform that is an interface between the post 12 and the ground. The base 14 may have, for example, a screw-type leveling mechanism that allows the scaffolding system 10 to be erected on uneven terrain. Alternatively, the leveling mechanism may also be, for example, hydraulic or have a telescoping section that may be secured by a pin, for example.

Figure 3:
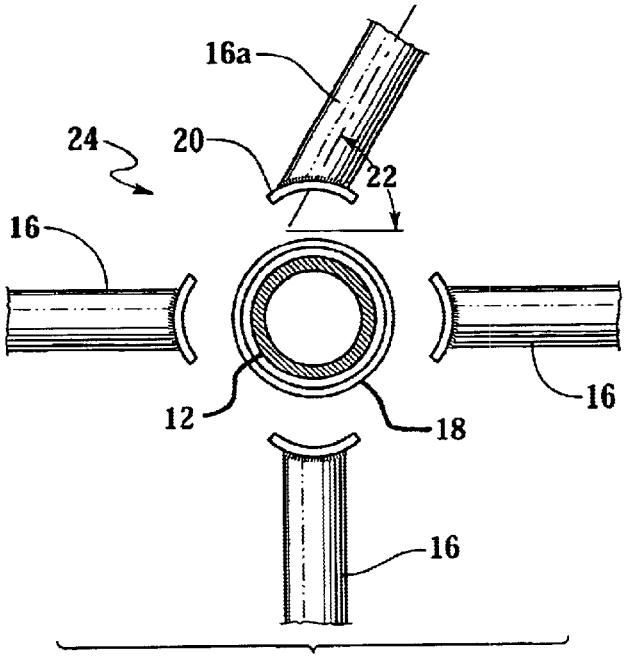
FIG. 3 is a plan view of a joint in a scaffolding system incorporating certain embodiments of the present invention.

FIG. 3 depicts an exploded view of a scaffold joint that may be assembled using the coupling 18. Rails 16 may be connected between the posts 12 with couplings 18. Rails 16, as with the other portions of the scaffold, may be made of any one of a variety of materials used in structural applications, including steel, aluminum, and composite materials. The rails 16 may have a cross-sectional shape such as those commonly used in structural applications, including square and round tubes, I-beams, and wide-flange sections. The couplings 18 may be, generally, conical sections that are connected to the posts 12 and serve to secure tabs 20. The tabs 20 may be rigidly attached to the rails 16. The tabs 20 may be attached to the ends of the rails 16 by, for example, welding, bolting, or forging the tabs 20 as an integral part of the rails 16. Other methods of joining the tabs 20 to the rails 16 will be apparent to one of ordinary skill in the art.

In one embodiment of the present invention, the tabs 20 may be a part of a flange that is attached to the rail 16. The tabs 20 are portions of the flange that extend radially beyond the circumference of the rail 16. Alternatively, the tabs 20 may be, for example, individual pieces of metal or other materials, such as composites, that are formed from, or attached to, the end of the rail 16. The tabs 20 may be formed from the end section of a metal rail 16, welded, screwed, or assembled in manners known to those of skill in the metalworking art. The tabs 20 may also be designed to conform to the radius of the post 12, which results in a more stable interface between the post 12 and the tabs 20.

The tabs 20 may be fixed to the rails 16 at a variety of different angles so that the scaffolding system 10 may be built to accommodate structures having irregular shapes. For example, as depicted in FIGS. 1 and 2, one section of the scaffolding system 10 may be oriented at an angle greater or less than ninety degrees to the adjoining section. Varying the angles that the tabs 20 are formed or fixed to the rails 16 and varying the lengths of the rails 16 allows the scaffolding system 10 to be assembled to conform to different buildings that have a variety of shapes. As another example, various lengths of rails 16 have angled tabs 20 that allow the scaffolding system 10 to be assembled to conform to round structures, such as storage tanks.

The tabs 20 that are formed or attached to the ends of the rails 16 may be disposed around the circumference of the post 12. Portions of each tab 20 are captured and secured between cups of the coupler 18. The tab 20 on a first end 24 of angled rail 16*a* may be attached at a first angle 22. The first angle 22 may range from between approximately five and eighty-nine degrees, for example.

Figure 4:
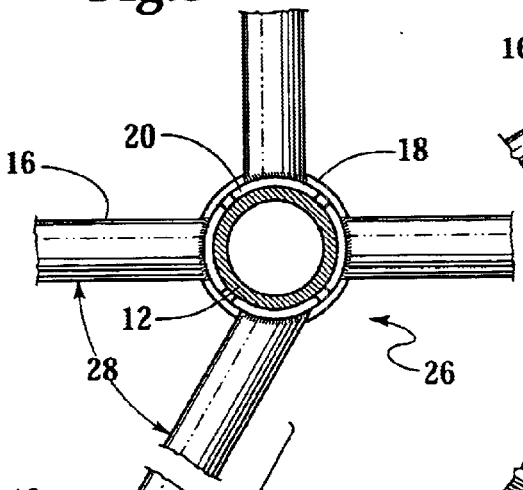
FIG. 4 is a plan view of a segment of a scaffolding system incorporating certain embodiments of the present invention.

FIG. 4 depicts the angled rail 16*a* connected between two couplings 18. The tab 20 on a second end 26 of the angled rail 16*a* may be secured to the angled rail 16*a* at a second angle 28 that may be approximately similar to the first angle 22. If the first angle 22 is the same as the second angle 28, the rails 16 of other scaffold sections will remain generally parallel or perpendicular to each other. As a result, the angled rail 16*a* allows square or rectangular sections of scaffolding to be safely joined together at angles other than ninety degrees. Additionally, the tabs 20 and the lengths of angled rails 16*a* may be designed to build the scaffolding system 10 to conform to the contours of many different structures.

Figure 5:
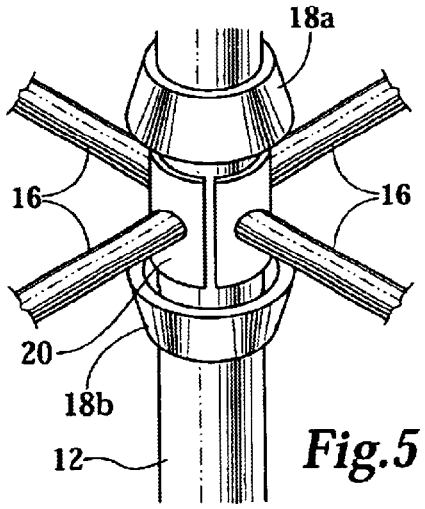
FIG. 5 is a perspective view of a coupler in a scaffolding system incorporating certain embodiments of the present invention.
Figure 6:
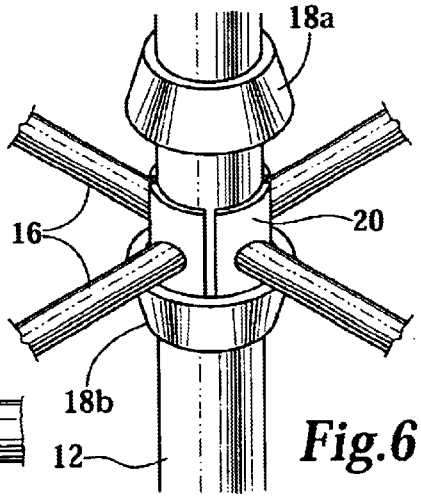
FIG. 6 is a perspective view of a coupler in a scaffolding system incorporating certain embodiments of the present invention.
Figure 7:
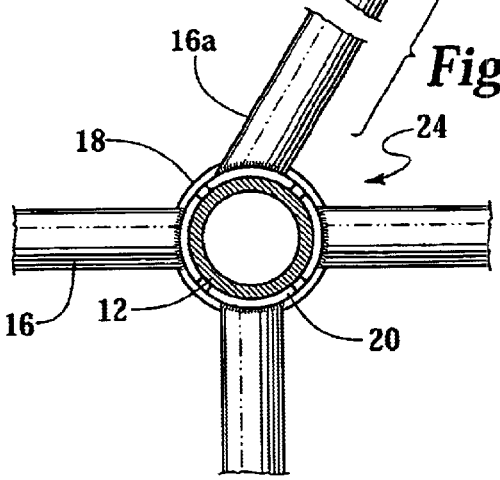
FIG. 7 is a perspective view of a coupler in a scaffolding system incorporating certain embodiments of the present invention.
Figure 7:
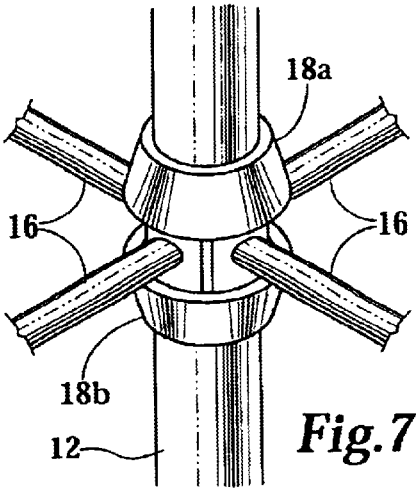

FIGS. 5–7 depict the operation of the coupling 18. FIG. 5 depicts four rails 16 that intersect at the post 12. The tabs 20 of the rails 16 may be evenly disposed around the circumference of post 12. The coupling 18 may have an upper section 18*a* and a lower section 18*b*, which are generally, for example, conical collars that are disposed around the post 12. The tabs 20 of the rails 16 may fit into the lower section 18*b* and be held against the post 12, as depicted in FIG. 6. Then, as depicted in FIG. 7, the upper section 18*a* may be secured over the tops of the tabs 20. The upper section 18*a* may have a locking mechanism that rotates to lock the tabs 20 against the post 12, which stabilizes the scaffold system 10. In this particular embodiment, the tabs 20 are more securely held in place by friction between the tabs 20 and the post 12. Other methods and systems of securing the rails 16 to the post 12 using the coupling 18 will be apparent to those having ordinary skill in the art of scaffolding.

Figure 8:
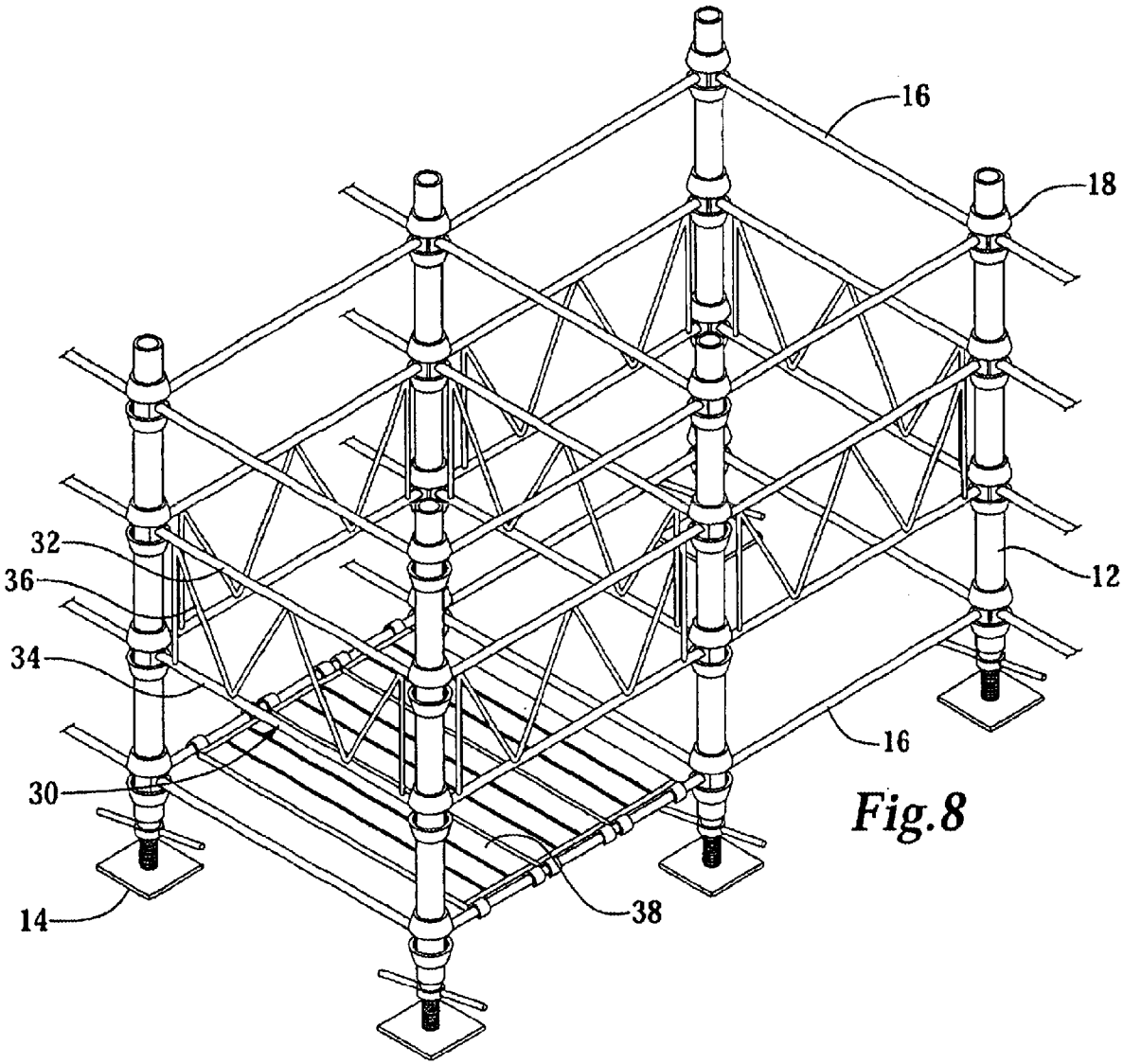
FIG. 8 is a perspective view of a scaffolding system incorporating certain embodiments of the present invention.

FIG. 8 depicts a scaffold system 10 having a guard rail panel 30. The guard rail panel 30 may have an upper brace 32 and a lower brace 34, which span between two posts 12. A bridging member 36 may connect between the upper brace 32 and the lower brace 34. The upper brace 32 and lower brace 34 may serve to provide extra safety to workers on the scaffold system 10. The bridging member 36 adds rigidity to the guard rail panel 30 and also may prevent workers and equipment from falling through the upper brace 32 and the lower brace 34.

The upper brace 32 and the lower brace 34 may be connected to the posts 12 by the same method used to connect the rails 16 to the posts 12. Tabs 20 may be attached to the ends of the upper brace 32 and the lower brace 34. The upper brace 32 and the lower brace 34 may then be attached to the posts 12 by the couplings 18. The height of the guard rail panel 30 may be adjusted relative to a platform 38. Different heights may be required according to the type of work, the dimensions of the structure or the height of the workers.

Figures 9, 10, 11:
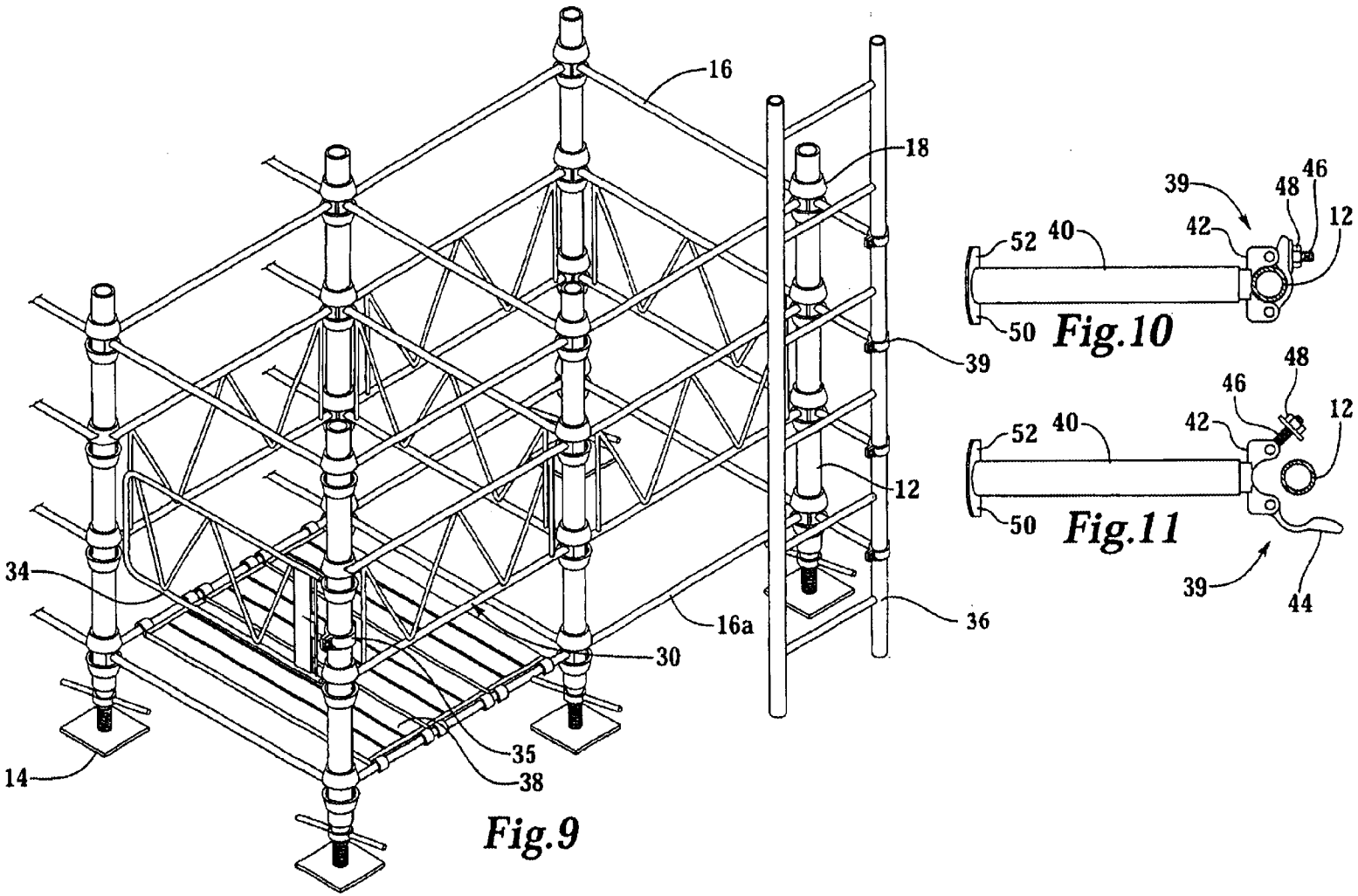
FIG. 9 is a perspective view of a scaffolding system incorporating certain embodiments of the present invention.
FIG. 10 is a plan view of a clamp arm of a scaffolding system incorporating certain embodiments of the present invention.
FIG. 11 is a plan view of a clamp arm of a scaffolding system incorporating certain embodiments of the present invention.

FIG. 9 is a perspective view of the scaffolding system incorporating certain embodiments of the present invention. In addition to guardrails 30 and platform 38 shown in FIG. 8, this embodiment incorporates a spring-loaded safety gate 33 and safety ladder 36 to facilitate safe movement of workers from platform 38 to other portions of the scaffold. In contrast to the method of attachment of rails 16 and guard rail panel 30 described above, safety gate 33 and safety ladder 36 are attached to posts 12 using, for example, mounting clamps 35 and 39, respectively.

FIGS. 10 and 11 are detail views of a mounting clamp 39 of the scaffolding system incorporating certain embodiments of the present invention. Mounting clamp 39 includes strut 40, inner jaw 42, outer jaw 44, threaded shank 46, and nut 48. In FIG. 10, clamp 39 is shown fastened to post 12. In various embodiments, clamp 39 may be fastened to ladder 36 or other portions of the scaffold, depending on the application. In FIG. 11, mounting clamp 39 is shown in its open condition, ready to receive post 12 and be fastened to it.

In order for mounting clamp 39 to be secured to post 12, mounting clamp 39 must first be disposed in the open position shown in FIG. 11. Once mounting clamp 39 is placed in the open position, the inner jaw 42, which is sized to receive post 12, can be moved into position around post 12. After inner jaw 42 is placed around post 12, outer jaw 44 is moved into position on the other side of post 12, thereby completely capturing post 12 between inner jaw 42 and outer jaw 44. The final steps in securing mounting clamp 39 to post 12 are to swing threaded shank 46 into position and to tighten nut 48, thereby securely fastening mounting clamp 39 around post 12. The process is the same for fastening ladder 36.

Figure 12:
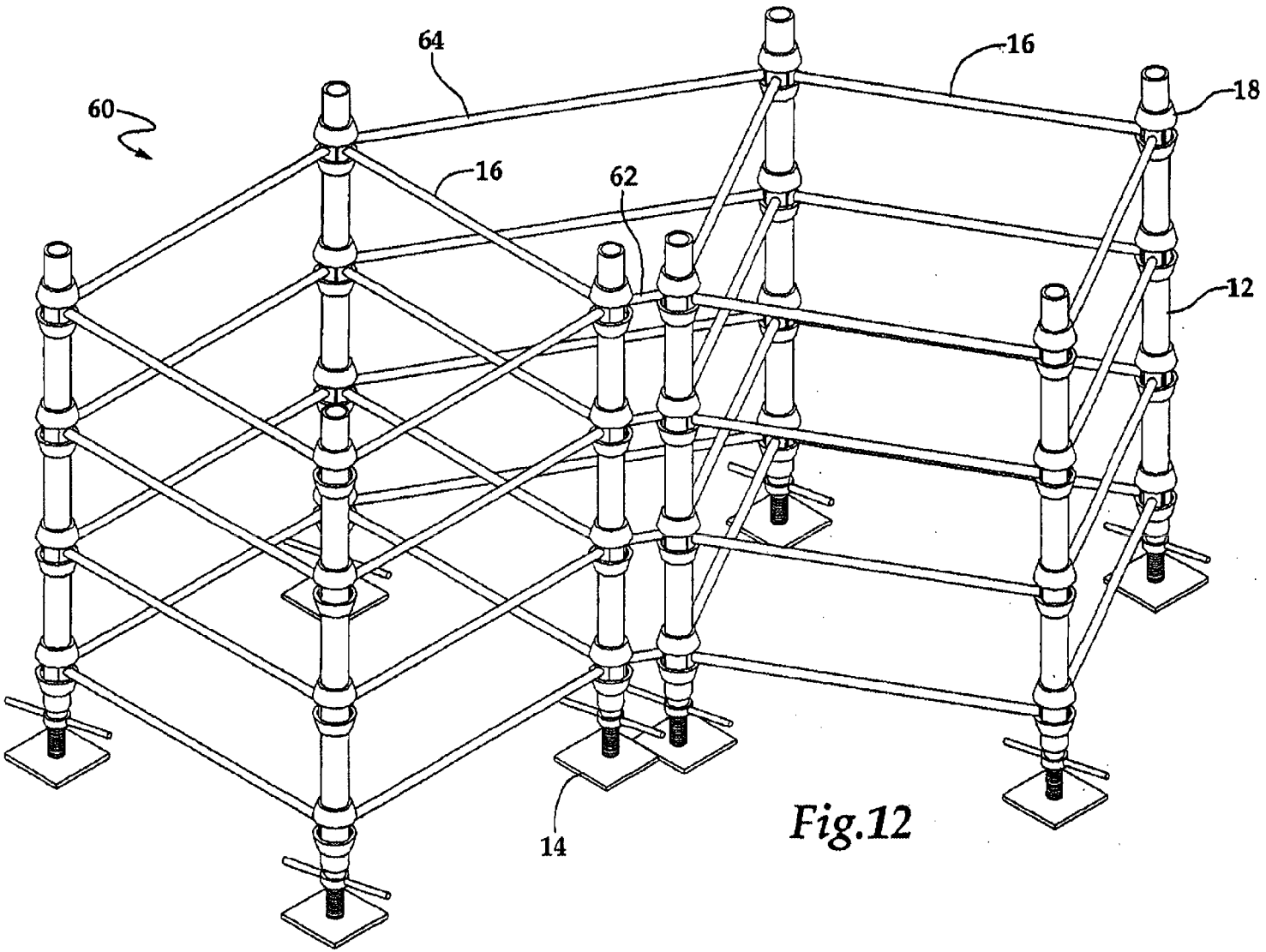
FIG. 12 is a perspective view of a scaffolding system incorporating certain embodiments of the present invention.

FIG. 12 is a perspective view of a scaffold 60 incorporating certain embodiments of the present invention. As with the above-described scaffolds, scaffold 60 of FIG. 12 comprises a series of vertical posts 12 rising from base levelers 14 tied together with horizontal rails 16 at couplers 18. In contrast to the above-described scaffolds, however, scaffold 60 is constructed in such a manner that it changes angular direction. Scaffold 60 would be useful, for example, where it is desirable to access two faces of a building at their intersection corner. Traditional scaffolding is designed for traditional building shapes, which generally incorporate right angles at the intersection of walls. Modern building designs, however, commonly make use of odd angles and curves, necessitating creative scaffolding solutions such as the present invention.

Certain prior designs have been developed which allow for construction of scaffolds having turns and intersections of greater than or less than 90 degrees, but such designs generally make use of adjustable sliding or rotating joints, or a combination of both, to allow for angles other than 90 degrees. Although these designs are adequate in certain situations, it is known that the adjustable joints can be a safety hazard, as they are a weak point in the design.

The present invention does not use pivoting or sliding joints. The present invention uses rails 64 having fixed lengths and mounting faces disposed at predetermined, fixed angles. The use of rails 64 having fixed, rather than adjustable, angles allows the construction of rails 64 to be much stronger, and therefore safer, than prior designs.

The use of rails 64 in the construction of an angled scaffold such as scaffold 60 can be clearly seen in FIG. 12. The portions of scaffold 60 to the right and left of rails 64 make use of rails 16 in a conventional box arrangement, such as is suitable for building along a flat, straight wall. In contrast, the center section of scaffold 60 makes use of angled rails 64 and shortened rails 62 in order to effectuate an angle difference between the left and right sides of scaffold 60.

Figure 13:
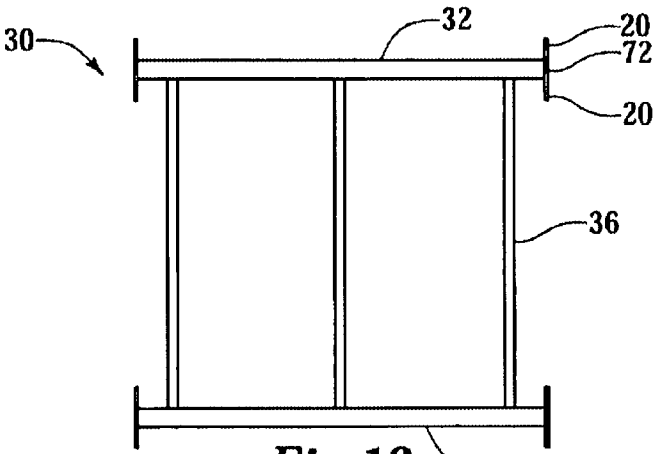
FIG. 13 is side view of one embodiment of a guard rail panel of the present invention.

A side view of one embodiment of a guard rail panel 30 of the present invention is shown in FIG. 13. Guard rail panel 30 includes upper brace 32 and lower brace 34. In the embodiment shown in FIG. 13, bridging members 36 connect the upper brace 32 to the lower brace 34. In the embodiment shown in FIG. 13, each of upper and lower braces 32 and 34 includes a mounting flange 72 comprising upper and lower tabs 20, to facilitate coupling to posts 12 at couplings 18.

The upper brace 32 and lower brace 34 may serve to provide extra safety to workers on the scaffold system 10. The bridging members 36 add rigidity to the guard rail panel 30 and also may prevent workers and equipment from falling through the space between upper brace 32 and lower brace 34.

The upper brace 32 and the lower brace 34 may be connected to the posts 12 by the same method used to connect the rails 16 to the posts 12. The upper brace 32 and the lower brace 34 may then be attached to the posts 12 by couplings 18. In certain embodiments, the height of the guard rail panel 30 may be adjusted relative to a platform 38. Different heights may be required according to the type of work, the dimensions of the structure or the height of the workers.

Figure 14:
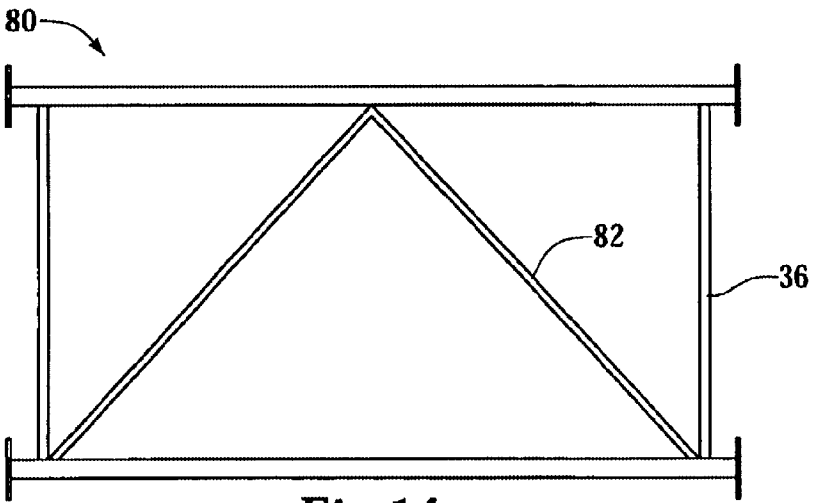
FIG. 14 is side view of a second embodiment of a guard rail panel of the present invention.

A side view of a second embodiment of a guard rail panel of the present invention is shown in FIG. 14 and generally designated 80. Guard rail panel 80 has the same basic structure as guard rail panel 30 described above. In contrast to guard rail panel 30, however, guard rail panel 80 incorporates a set of diagonal bridging members 82 in addition to vertical bridging members 36. Diagonal bridging members 82 serve to strengthen and stiffen guard rail panel 80. In the embodiment shown in FIG. 13, diagonal bridging members 82 are disposed to carry vertical loads applied in the center region of guard rail panel 80 to the outside corners of the structure, where guard rail panel 80 is stronger.

Figure 15:
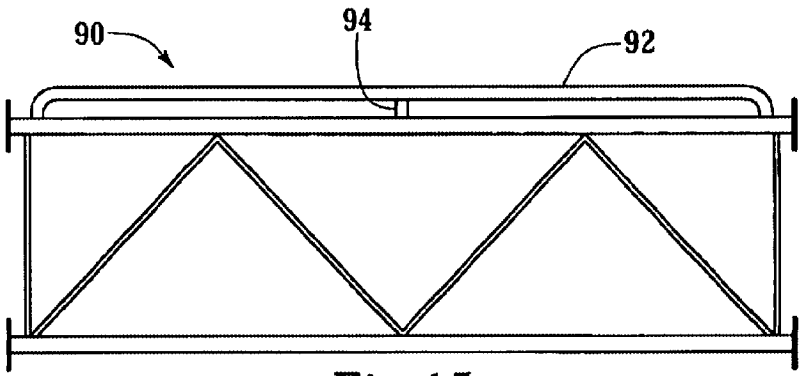
FIG. 15 is a side view of a third embodiment of a guard rail panel of the present invention.

A side view of a third embodiment of a guard rail panel of the present invention is shown in FIG. 15 and generally designated 90. Guard rail panel 90 incorporates the basic structure of guard rail panels 30 and 80, with additional structural reinforcement to facilitate use in applications requiring longer unsupported spans or higher load-carrying capacity. As seen in FIG. 15, guard rail panel 90 incorporates a reinforcing rail 92 and reinforcing column 94 attached to the top of upper brace 32. The additional strength and stiffness provided by reinforcing rail 92 and reinforcing column 94 allow guard rail panel 90 to be used in more demanding applications than guard rail panels 30 and 80.

Figure 16:
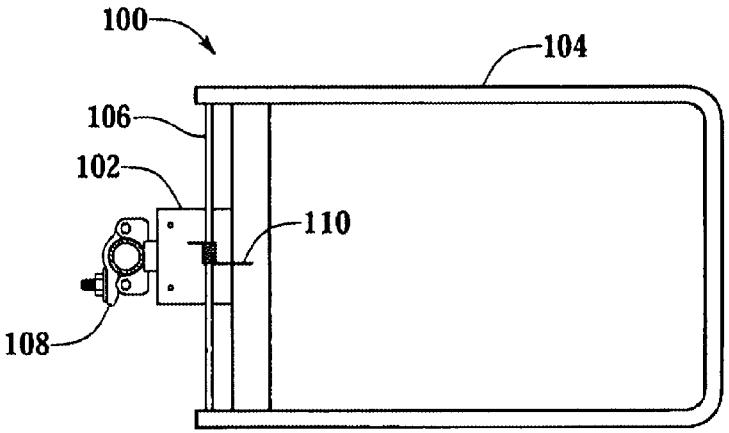
FIG. 16 is a side view of a safety gate of the present invention.

A side view of a safety gate of the present invention is shown in FIG. 16 generally designated 100. Safety gate 100 includes hinge 102 and gate frame 104. Gate frame 104 is mounted to, and swings around, hinge pivot rod 106. Safety gate 100 can be mounted to scaffolding in any of a manner of methods and structures known to those of skill in the art of mechanical structures. The embodiment shown in FIG. 16 is designed to be mounted to a vertical member of a scaffold by means of mounting clamp 108. The embodiment shown in FIG. 16 is designed to be self-closing due to the action of closing spring 110 on hinge 102, which acts to swing gate frame 104 closed in the absence of an opening force.

Figure 17:
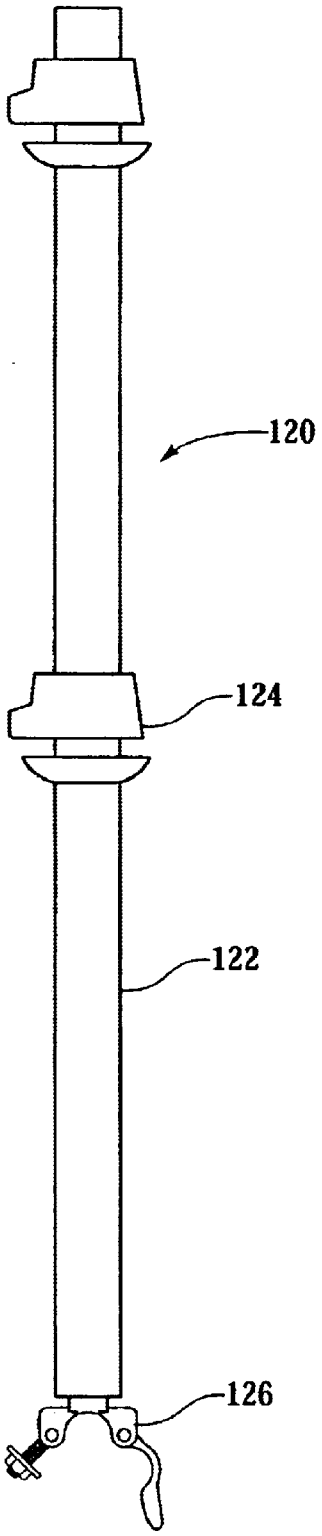
FIG. 17 is a side view of a supplemental vertical strut according to one embodiment of the present invention.

FIG. 17 is a side view of a supplemental vertical strut, generally designated 120, according to one embodiment of the present invention. Supplemental vertical strut 120 includes post 122, one or more cup-type couplings 124, and one or more mounting clamps 126. Supplemental vertical strut 120 can be used to provide a vertical structural member when needed at a point along a rail 16 in between posts 12. Supplemental vertical strut 120 can be used, for example, to create a "doorway" opening with guard rail panel on either side. Such a doorway could be left open, or could be provided with a safety gate such as safety gate 100, for example. Supplemental vertical strut 120 is shown with a single mounting clamp 126 installed, but most embodiments will incorporate one mounting clamp at each end, so as to be secured to an upper and lower horizontal rail.

Figure 18:
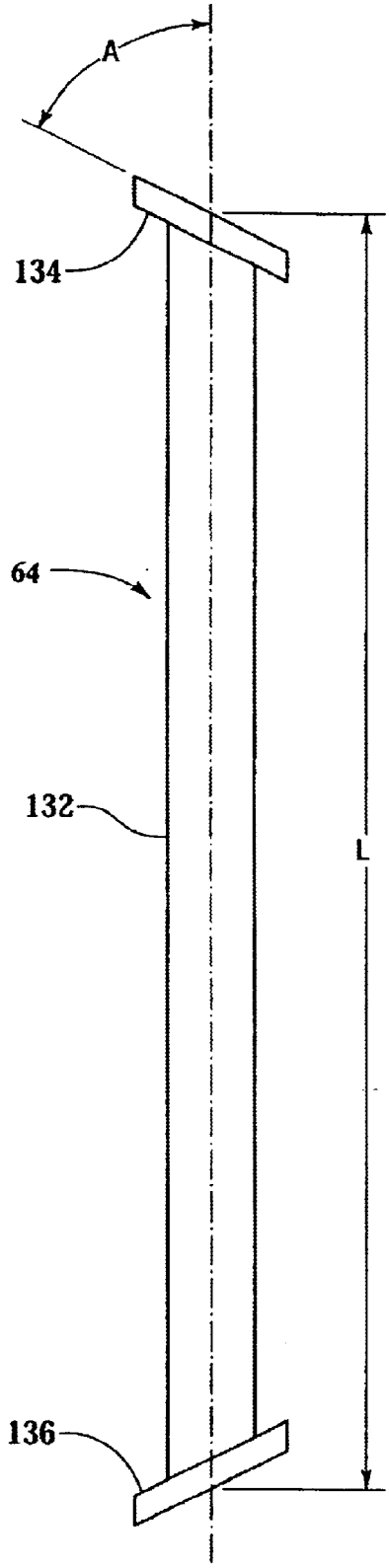
FIG. 18 is a detail view of an angled rail according to one embodiment of the present invention.

A detail view of an angled rail 64 can be seen in FIG. 18. As shown in FIG. 18, angled rail 64 has a center section 132 having a length L, and end sections 134 and 136, each disposed at an angle A from the principal axis of center section 132. Each of end sections 134 and 136 incorporates upper and lower tabs, as described elsewhere for connection to cup-type locking couplers. The length L of the center section 132 and angle A of end sections 134 and 136 will vary depending upon the application. One embodiment of the present invention incorporates angled rails 64 having a length L of 28.5 inches and angle A of 22.5 degrees to accommodate, for example, a 45-degree angle in the scaffold structure.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is not intended to be exhaustive or to limit the scope of the invention. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

What is claimed is:

1. A scaffold joint comprising:

a vertical post having a lengthwise axis;

a lower joint section, having an interior surface, disposed around the vertical post;

an upper joint section, having an interior surface, disposed around the vertical post; and a first structural brace comprising:

a center section having a lengthwise axis, a first end, and a second end;

a first mounting flange rigidly attached to the first end, comprising a mounting surface having a center, an upper tab, and a lower tab; and a second mounting flange rigidly attached to the second end, comprising a mounting surface having a center, an upper tab, and a lower tab, and wherein a vector normal to the mounting surface at the center is disposed at an angle of between approximately 1 degree and approximately 89 degrees to the lengthwise axis of the center section;

a second structural brace comprising:

a center section having a lengthwise axis, a first end, and a second end;

a first mounting flange rigidly attached to the first end, comprising a mounting surface having a center, an upper tab, and a lower tab; and a second mounting flange rigidly attached to the second end, comprising a mounting surface having a center, an upper tab, and a lower tab, and wherein a vector normal to the mounting surface at the center is disposed parallel to the lengthwise axis of the center section;

wherein the lower tab of each of the second mounting flanges is disposed within the lower joint section, the upper tab of each of the second mounting flanges is disposed within the upper section, and the lengthwise axis of the first structural brace is disposed at an angle of between approximately 1 degree and approximately 89 degrees to the lengthwise axis of the second structural brace.

2. The scaffold joint of claim 1 wherein the vector normal to the mounting surface at the center of the first mounting flange is disposed at an angle of between approximately 5 degrees and approximately 85 degrees to the lengthwise axis of the center section.

3. The scaffold joint of claim 1 wherein the vector normal to the mounting surface at the center of the first mounting flange is disposed at an angle of between approximately 10 degrees and approximately 80 degrees to the lengthwise axis of the center section.

4. The scaffold joint of claim 1 wherein the vector normal to the mounting surface at the center of the first mounting flange is disposed at an angle of between approximately 15 degrees and approximately 75 degrees to the lengthwise axis of the center section.

5. The scaffold joint of claim 1 wherein the vector normal of the first mounting flange and the vector normal of the second mounting flange are disposed at the same angle.

6. The scaffold joint of claim 1 wherein the vector normal of the first mounting flange and the vector normal of the second mounting flange are disposed at opposite angles.

7. The scaffold joint of claim 6 wherein the vector normals are disposed at an angle of approximately 22.5 degrees to the principal axis of the center section.

8. The scaffold joint of wherein the vector normals are disposed at an angle of approximately 15 degrees to the principal axis of the center section.

9. The scaffold joint of claim 6 wherein the vector normals are disposed at an angle of approximately 30 degrees to the principal axis of the center section.

10. The scaffold joint of claim 6 wherein the vector normals are disposed at an angle of approximately 36 degrees to the principal axis of the center section.

11. The scaffold joint of claim 6 wherein the vector normals are disposed at an angle of approximately 60 degrees to the principal axis of the center section.

12. The scaffold joint of claim 1 wherein the brace is made of metal.

13. The scaffold joint of claim 12 wherein the brace is made of tubular steel.

14. The scaffold joint of claim 1 wherein the brace is made of composite.

15. The scaffold joint of claim 1 wherein the brace is made of carbon fiber.

16. The scaffold joint of claim 1 wherein the length of the center section is approximately 28.5 inches.

* * * * *